United States Patent [19]

Suematsu et al.

[11] Patent Number: 4,599,289

[45] Date of Patent: Jul. 8, 1986

[54] PRESSURE-FIXABLE ENCAPSULATED TONER

[75] Inventors: Koushi Suematsu, Kawasaki; Tetsuo Hasegawa, Tokyo; Ichiro Osaki, Kawasaki, all of Japan

[73] Assignee: Canon Kabushiki Kaisha, Tokyo, Japan

[21] Appl. No.: 715,573

[22] Filed: Mar. 22, 1985

Related U.S. Application Data

[63] Continuation of Ser. No. 497,160, May 23, 1983, abandoned.

[30] Foreign Application Priority Data

May 27, 1982 [JP] Japan ..... 57-90267
May 31, 1982 [JP] Japan ..... 57-92503

[51] Int. Cl.[4] ..... G03G 9/08; G03G 9/14; G03G 13/20

[52] U.S. Cl. ..... 430/98; 430/99; 430/106.6; 430/109; 430/110; 430/126; 430/138; 428/407

[58] Field of Search ..... 430/106.6, 109, 110, 430/138, 98, 99, 126; 428/407

[56] References Cited

U.S. PATENT DOCUMENTS 2,221,776 11/1940 Carlson .
2,297,691 10/1942 Carlson .
2,618,552 11/1952 Wise .
2,874,063 2/1959 Grieg .
3,269,626 8/1966 Albrecht .
3,326,848 6/1967 Clemens .
3,338,991 8/1967 Insalaco .
3,405,071 10/1968 Reyes ..... 430/138 X
3,502,582 3/1970 Clemens .
3,612,682 10/1971 Shelffo .
3,655,282 4/1972 Turner .
3,666,363 5/1972 Tanaka .
3,731,358 5/1973 Artl .
3,788,994 1/1974 Wellman et al. ..... 430/109
3,794,078 8/1976 Crystal ..... 430/138 X
3,893,933 7/1975 Brown ..... 430/109
4,016,099 4/1977 Wellman et al. ..... 430/109 X
4,071,361 1/1978 Marushima .
4,307,169 12/1981 Matkan ..... 430/110 X

FOREIGN PATENT DOCUMENTS 55-166654 12/1980 Japan ..... 430/110
1210665 10/1970 United Kingdom .
1414159 11/1975 United Kingdom .

*Primary Examiner*—Roland E. Martin
*Attorney, Agent, or Firm*—Fitzpatrick, Cella, Harper & Scinto

[57] ABSTRACT

A pressure-fixable encapsulated toner each capsule of which comprises a core containing a pressure-fixable component and a shell entirely or partially covering the core, characterized in that the shell comprises a copolymer of 95–70% by weight of vinylidene chloride and 5–30% by weight of acrylonitrile. This encapsulated toner is excellent in the covering property of the shell, is easy to prepare, and exhibits good stable triboelectrical chargeability, developing ability, and pressure fixability to plain paper, during many repeated service operations.

16 Claims, No Drawings

PRESSURE-FIXABLE ENCAPSULATED TONER

This application is a continuation of application Ser. No. 497,160 filed May 23, 1983, now abandoned.

BACKGROUND OF THE INVENTION

1. Field of the Invention

This invention relates to a toner used for developing positive electrostatic latent images in electrophotography and electrostatic printing, and more particularly to an encapsulated toner suitable for pressure fixation 2. Description of the Prior Art While many electrophotographic processes have been known as described in U. S. Pat. Nos. 2297691, 3666363 and 4071361 and in other documents, these processes generally comprise forming an electrostatic latent image on a photoconductive layer by some method or other utilizing photoconductive materials, developing the latent image with a toner, and if necessary, transferring the toner image onto a transfer medium such as paper, followed by fixing the transferred image thereupon by applying heat, pressure, or a solvent vapor, to complete a copy.

Various development processes are also known for visualizing such electrostatic latent images by use of a toner, including, for example, the magnetic brush process as described in U.S. Pat. No. 28740603, cascade process as in U.S. Pat. No. 2618552, powder cloud process as in U.S. Pat. No. 2221776, fur brush process, liquid process, and the like.

Toners conventionally used in these development processes are fine powders prepared by dispersing dyes or pigments in natural or synthetic resins. Further, there are known finely powdered toners incorporated with a third material for various purposes.

Developed images are transferred, as required, onto transfer media such as paper and the like. Known methods for fixing toner images include those wherein toner images are heated with a heater, heat roller, or other means to fuse them to the supporting medium; wherein the binder resin in toner images is softened or dissolved in an organic solvent to fix to the supporting medium; and wherein toner images are fixed with pressure to the supporting medium.

In general, a toner is selected so as to fit a given fixing process, and the toner fitting a given fixing process cannot be used in other fixing processes. It is almost impossible, in particular, that a toner for use in the hot melt fixing process so far widely practiced employing a heater is applied to another fixing process such as the heat roller fixing process, solvent fixing process, or pressure fixing process. Accordingly, toners suited for individual fixing processes are under research and development.

The process for fixing a toner with pressure, described in U.S. Pat. No. 3269626 and other documents, has many advantages such as capability of energy saving, no environmental pollution, capability of copying without waiting after the copying machine has been switched on, no danger of scorching a copy, possibility of a high fixing rate, and simplicity of fixing devices available.

This fixing process, however, involves problems in fixabilities of toners and in the offset phenomenon, which is a trouble of transferring toner images to the surface of a pressure roller employed, so that various researches and developments are in progress in order to solve these problems. For example, a pressure-fixable toner containing an aliphatic compound and a thermoplastic resin has been disclosed in U.K. Pat. No. 1210665, an encapsulated pressure-fixable toner having a soft material in the core has been disclosed in U.S. Pat. No. 3788994, and a pressure fixable toner utilizing a block copolymer of a high stiffness polymer component and a flexible polymer component has been disclosed in U.K. Pat. No. 1414159.

However, it has not been successful to obtain a practically useful pressure-fixable toner which is easy to manufacture, has adequate pressure fixability, does not cause the pressure-roller-offset phenomenon, maintains a developing ability and fixability stable to a great number of repeated uses, does not undergo coalescence with the carrier, development metallic sleeve, or photosensitive member surface employed, and has such a good stability as not to agglomerate or cake during storage.

For instance, pressure-fixable toners comprising a soft material, although good in pressure fixability, are difficult to prepare by fine grinding and are liable to cause the pressure-roller-offset phenomenon, to undergo coalescence with the carrier and the photosensitive member surface, and to agglomerate or cake.

On the other hand, rigid resins, although easy to make up into toners and excellent in electrical chargeability and storage stability, are extremely poor in pressure fixability. It is because rigid resins are mostly harder than the cellulose fiber of paper, and hence, when pressed, are merely crushed into the paper without being entangled with the fiber.

Various pressure-fixable encapsulated toner hitherto known involve the following problem: when the core is made of a soft material having good pressure fixability, its deposition on the pressure roller becomes gradually remarkable as the pressure fixing is repeated more and more; this eventually causes the offset phenomenon or the winding of the transfer paper around the pressure roller; if a rigid material is used in the core in order to avoid these phenomena, the pressure fixability will be deteriorated.

Recently, a further process has been put into practice for developing electrostatic latent images with a one-component developer which comprises no carrier but a toner containing fine magnetic particles. In this case, the binder resin in the toner is requested to be satisfactory in miscibility with magnetic particles, adhesion thereto, and impact strength and free flow property of toner particles. It is very difficulst to meet these requirements as well as pressure fixability.

SUMMARY OF THE INVENTION

An object of this invention is to provide a pressure-fixable encapsulated toner free of the above noted disadvantages by use of materials different from those used in prior art.

Another object of this invention is to provide a pressure-fixable encapsulated toner which has a shell material of good covering property and is easy to prepare.

Another object of this invention is to provide a pressure-fixable encapsulated toner having a stable triboelectric chargeability.

Another object of this invention is to provide a pressure-fixable encapsulated toner which exhibits an excellent pressure-fixability to plain paper and maintains stable developing ability and fixability during reproduction of a great number of copies.

Another object of this invention is to provide a pressure-fixable encapsulated toner for a one-component developer, said toner containing fine magnetic particles and exhibiting good pressure fixability and adequate magnetism, and the electrostatic transfer of images developed with said toner being possible.

Thus, this inveniton provide a pressure-fixable encapsulated toner each capsule of which comprises a core containing a pressure-fixable component and a shell entirely or partially covering the core, characterized in that the shell comprises a copolymer of 95–70% by weight of vinylidene chloride and 5–30% by weight of acrylonitrile.

The pressure-fixable encapsulated toner of this invention is also characterized in that the shell comprises a copolymer of 95–70% by weight of vinylidene chloride and 5–30% by weight of acrylonitrile and additionally a polystyrene family resin.

The encapsulated toner according to this invention, because each capsule thereof has a strong shell having a good covering property, is stable in performance characteristics during service and storage, even when the core is made of a soft material, and exhibits good pressure fixability. In addition, since the triboelectrical chargeability is good and stable, the present toner is excellent in developing ability.

DESCRIPTION OF THE PREFERRED EMBODIMENTS

The vinylidene chloride-acrylonitrile copolymer used in this invention is required to have a weight ratio of the former monomer to the latter of 95:5–70:30. Reasons for this are that the vinylidene chloride content exceeding 95% by weight leads to deterioration of heat and light stabilities and poor processability of the copolymer because the copolymer becomes insoluble in solvents, and that the acrylonitrile content exceeding 30% by weight results in deterioration of humidity stability and unstable triboelectric chargeability.

Polystyrene family resins that can be used together with the vinylidene chloride-acrylonitrile copolymer in the shell include all the known polymers of this family, for example, polystyrene, poly(p-chlorostyrene), polyvinyltoluene, styrene-butadiene copolymer, and styrene-acrylic acid copolymer.

Accordingly, as employed herein, the phrase "polystyrene family resin" includes homopolymers and copolymers of styrene or its derivatives.

Suitable mixing ratios of the vinylidene chloride-acrylonitrile copolymer to the polystyrene family resin vary depending upon the vinylidene chloride to acrylonitrile ratio and the kind of the polystyrene family resin, but are generally 1:1–20:1 by weight.

Other resins can also be incorporated into the shell in amounts (up to 30% by weight of the shell material) which do not make difficult the achievement of the object of this invention. These resins are homopolymers, copolymers, and polymer blends, including, for example, polymers of acrylates or methacrylates such as methyl acrylate, ethyl acrylate, butyl acrylate, methyl methacrylate, ethyl methacrylate, butyl methacrylate, and N,N-dimethylaminoethyl methacrylate; maleic type polymers such as polymers of maleic anhydride, maleic acid half-esters, maleic acid half-amide, maleic acid diester, and maleimide; nitrogen-containing vinyl resins such as polyvinylpyridine, and poly(N-vinylimidazole); vinyl acetal resins such as poly(vinyl formal) and poly(vinyl butyral); vinyl resins such as poly(vinyl chloride) and poly(vinyl acetate); polyolefin resins such as polyethylene and polypropylene; polyacrylonitrile, polyester, polycarbonate, polysulfonate, and polyamide resins; urethane, urea-formaldehyde, melamine, epoxy, and phenolic resins; rosin, modified rosin, and terpene resin; aliphatic, alicyclic, and aromatic petroleum resins; and polyether or polythioether resins such as poly(phenylene oxide).

Suitable thickness of the shell somewhat varies depending upon the kinds of shell and core materials, but is generally 0.5–3$\mu$, preferably 0.8–2$\mu$. In general, the shell, if too thin, makes worse the developing ability and if too thick, makes worse pressure fixability.

Materials adaptable for the pressure-fixable component of the core are desired to be readily entangled with fibers of plain paper under a line pressure of about 25 Kg/cm. Such materials include, for example, polyolefin resins such as polyethylene, polypropylene; fluorocarbon polymers such as polytetrafluoroethylene; ethylene copolymers such as ethylene-ethyl acrylate copolymer and ethylene vinyl acetate copolymer; polyesters; styrene polymer or copolymers such as polystyrene, styrene-butadiene copolymer, and styrene-acrylate copolymers; higher fatty acids such as palmitic acid, stearic acid, and lauric acid; and other various resins such as polyvinylpyrrolidone, epoxy resins, phenol-terpene copolymer, polymethylsiloxane, maleic acid-modified phenol resin, and methyl vinyl ether-maleic anhydride copolymer. Among these materials, polyolefins are preferable and polyethylene is most suitable, in view of fixability, releasability (roll-strippability), and developing ability.

Any dye or pigment so far used as a colorant for toners can be incorporated as required into the encapsulated toner of this invention. Such a colorant may be added to either of the core material and the shell material or to both the material. As examples of the colorant may be cited various types of carbon black, Aniline Black, Naphthol Yellow, Molybdenum Orange, Rhodamine lake, Alizarin lake, Methyl violet lake, Phthalocyanine Blue, Nigrosine, Methylene Blue, Rose Bengal, and Quinoline Yellow.

A magnetic toner, if desired, can be prepared by merely adding fine magnetic particles to the core and/or shell material. Any material having magnetism or being magnetizable can be used; including known magnetic materials, for example; fine powders of metals such as iron, manganese, nickel, cobalt, and chromium; various kinds of ferrites; alloys and compounds of manganese and the like; and other ferromagnetic alloys. Suitable amounts of fine magnetic particles added are 15–70 parts by weight based on 100 parts by weight of the whole resin in the toner.

An electric-charge controlling agent, such as a metal complex dye or nigrosine, so far used in toners can be added in a suitable amount to the shell resin. Alternatively, fine particles of such an electric-charge controlling agent can be mixed with the toner (to be attached to the outsides of toner capsules).

Various known encapsulation techniques can be applied to the preparation of the encapsulated toner of this invention; for example, there may be applied the spray drying method, interfacial polymerization method, coacervation method, phase separation method, in-situ method, and methods described in U.S. Pat. Nos. 3338991, 3326848, 3502582 and the like. When two or more kinds of shell materials are used in such a manner that the vinylidene chloride-acrylonitrile copolymer and the polystyrene family resin are used cojointly, these materials may be fed at the same time or successively to form double-or triple-wall shells.

Images developed with the toner of this invention are fixed by passing the image-bearing media (e.g. transfer paper) through a pair of pressed rollers, where supplemental heating may or may not be applied. Pressure fixing devices described in Japanese Patent Pub. No. 12797/69, and U.S. Pat. Nos. 3269626, 3612682, 3655282, and 3731358 can be used for fixing images developed with the toner of this invention.

This invention is illustrated further referring to the following examples, wherein all parts are by weight.

EXAMPLE 1

The following mixture was melted, kneaded, and pulverized in a jet mill to prepare a core material of 5–20μ in particle size:

Component of mixture:

(1) Polyethylene wax (Hiwax 320 P of Mitsui Petrochem. Ind. Co., Ltd.): 100 Parts (2) Magnetite (EPT-1000 of Toda Kogyo Co., Ltd): 80 parts One Kg of this core material was dispersed in the following solution:

Component of solution:

(1) Vinylidene chloride-acrylonitrile (91:9 in weight ratio) copolymer (Saran Resin F-216 of Asahi-Dow Chem. Inc.): 50 g (2) Tetrahydrofuran: 3 l According to the phase separation method, toner capsules were formed by adding dropwise 1.0 l of water to the dispersion, followed by filtration and drying.

The encapsulated toner obtained was subjected to a development and fixing test using a copying machine (NP-120 of Canon ), giving good images. The images were firmly fixed at a line pressure of 25 Kg/cm. During 30,000 duplications, no deterioration was observed in image quality.

EXAMPLE 2

The following mixture was melted, kneaded, and finely pulverized to prepare a core material of 5–20μ in particle size:

Component of mixture:

(1) Polyethylene wax (Hiwax 320 P of Mitsui Petrochem. Ind. Co., Ltd.): 100 parts (2) Carbon black: 7 parts One Kg of this core material was dispersed in the following solution and therefrom an encapsulated toner was prepared by the spray drying method:

Component of solution:

(1) Vinylidene chloride-acrylonitrile (8:2 in weight ratio) copolymer: 100 g (2) Tetrahydrofuran: 3 l One Kg of powdered iron was mixed with 100 g of the encapsulated toner thus prepared. The resulting developer was subjected to a development and fixing test using a copying machine (NP-5000, mfd. by Canon). The developed images were firmly fixed by passing the image bearing paper through two pairs of metal rollers at a line pressure of 25 Kg/cm. During 20,000 duplications, no deterioration was observed in image quality.

EXAMPLE 3

The following mixture was melted, kneaded, and finely pulverized to prepare a core material of 5–20μ in particle size:

Component of mixture:

(1) Polyethylene wax (Hiwax 320 P of Mitsui Petrochem. Ind. Co., Ltd.): 100 parts (2) Carbon black: 10 parts One Kg of the core material was dispersed in the following solution, and therefrom an encapsulated toner was prepared by the spray drying method:

Component of solution:

(1) Vinylidenechloride-acrylonitrile (91:9 in weight ratio) copolymer (the same as of Example 1): 100 g (2) Polystyrene (Styron 666 of Asahi-Dow Chem. Inc.): 50 g (3) Tetrahydrofuran: 3 l One Kg of powdered iron was mixed with 100 g of the encapsulated toner thus prepared. The resulting developer was subjected to a development and fixing test using a copying machine (NP-5000 of Canon). Good, firmly fixed images were obtained by passing the image bearing paper through two pairs of metal rollers at a line pressure of 25 Kg/cm. During 40,000 duplications, no deterioration was observed in image quality.

EXAMPLE 4

The following mixture was melted, kneaded, and pulverized to prepare a core material of 5–20μ in particle size:

Component of mixture:

(1) Polyethylene wax (Hiwax 200 P of Mitsui Petrochem. Ind. Co., Ltd.): 100 parts (2) Magnetite (EPT-1000 of Toda Kogyo Co., Ltd.): 80 parts One Kg of the core material was dispersed in the following solution containing:

(1) Vinylidene chloride-acrylonitrile (91:9 in weight ratio) copolymer (the same as of Example 1): 150 g (2) Styrene-acrylonitrile copolymer (Ionac X-230 of Ionac Chem. Co.): 50 g (3) Tetrahydrofuran: 3 l According to the phase separation method, toner capsules were formed by adding dropwise 1.0 l of water to the dispersion, followed by filtration and drying.

The encapsulated toner obtained was subjected to a development and fixing test using a copying machine (NP-120 of Canon). Good, firmly fixed images were obtained at a line pressure of 25 Kg/cm. During 30,000 duplications, no deterioration was observed in image quality.

We claim:

1. A pressure-fixable encapsulated toner, comprising a pressure fixable polyolefin core containing a colorant and a shell entirely covering the core, the shell comprising a copolymer of 95 to 70% by weight of vinylidene chloride and 5 to 30% by weight of acrylonitrile, the weights based on the weight of the copolymer.

2. The toner of claim 1, wherein the colorant is carbon black.

3. The toner of claim 1, wherein the colorant is fine magnetic particles.

4. The toner of claim 1, wherein the polyolefin is polyethylene.

5. The toner of claim 1, which is mixed with powdered iron.

6. A pressure-fixable encapsulated toner, comprising a pressure fixable polyolefin core containing a colorant and a shell entirely covering the core, the shell comprising a copolymer of 95 to 70% by weight of vinylidene chloride and 5 to 30% by weight of acrylonitrile based on the weight of the copolymer and a polystyrene family resin selected from the group consisting of homopolymers and copolymers of styrene or its derivatives, wherein the weight ratio of the vinylidene chloride-acrylonitrile copolymer to the polystyrene family resin is in the range of 1:1 to 20:1.

7. The toner of claim 6, wherein the polystyrene family resin is polystyrene.

8. The toner of claim 6, wherein the polystyrene family resin is a copolymer prepared from styrene and acrylic monomer.

9. The toner of claim 6, wherein the colorant is carbon black.

10. The toner of claim 6, wherein the colorant is fine magnetic particles.

11. The toner of claim 6, wherein the polyolefin is polyethylene.

12. The toner of claim 6, which is mixed with powdered iron.

13. An electrophotographic process for developing an electrostatic latent image, comprising:

forming an electrostatic latent image on a photoconductive layer;

developing the latent image with a pressure-fixable encapsulated toner of claim 1 to obtain a toner image;

transferring the obtained toner image onto a transfer medium; and fixing the transferred toner image thereon by applying pressure.

14. The process of claim 13, wherein the transferred toner image thereon is fixed by applying pressure and supplemental heating.

15. An electrophotographic process for developing an electrostatic latent image, comprising:

forming an electrostatic latent image on a photoconductive layer;

developing the latent image with a pressure-fixable encapsulated toner of claim 6 to obtain a toner image;

transferring the obtained toner image onto a transfer medium; and fixing the transferred toner image thereon by applying pressure.

16. The process of claim 15, wherein the transferred toner image thereon is fixed by applying pressure and supplemental heating.

* * * * *